United States Patent [19]

Bozarth

[11] 4,108,260

[45] Aug. 22, 1978

[54] ROCK BIT WITH SPECIALLY SHAPED INSERTS

[75] Inventor: Rex O. Bozarth, Houston, Tex.

[73] Assignee: Hughes Tool Company, Houston, Tex.

[21] Appl. No.: 783,924

[22] Filed: Apr. 1, 1977

[51] Int. Cl.[2] ..... E21B 9/36

[52] U.S. Cl. ..... 175/374; 175/376; 175/410

[58] Field of Search ..... 175/374, 375, 376, 377, 175/378, 410

[56] References Cited

U.S. PATENT DOCUMENTS

| | | | |
|---|---|---|---|
| 1,859,717 | 5/1932 | Rutrle | 115/410 X |
| 3,388,757 | 6/1968 | Fittinger | 175/410 |
| 3,743,038 | 7/1973 | Bennett | 175/374 |
| 4,006,788 | 2/1977 | Garner | 175/410 |

FOREIGN PATENT DOCUMENTS

| | | | |
|---|---|---|---|
| 187,697 | 12/1966 | U.S.S.R. | 175/376 |
| 244,980 | 10/1969 | U.S.S.R. | 175/374 |

*Primary Examiner*—Ernest R. Purser
*Assistant Examiner*—William F. Pate, III
*Attorney, Agent, or Firm*—Robert A. Felsman

[57] ABSTRACT

A specially shaped insert of the type used for the cutter teeth of rock bits used in drilling soft and medium formations of the earth. The insert is generally chisel-shaped with flanks converging to a crest. The flanks are asymmetrical with respect to each other. The leading flank is scoop-shaped and the trailing flank is rounded outwardly.

7 Claims, 5 Drawing Figures

ROCK BIT WITH SPECIALLY SHAPED INSERTS

BACKGROUND OF THE INVENTION

1. Field of the Invention

This invention relates in general to earth boring bits and in particular to an insert type rock bit of the rolling cutter type having specially shaped cutting tips.

2. Description of the Prior Art

Rock bits using sintered tungsten carbide inserts or compacts with cutting tips having a generally wedge or chisel-shaped configuration are used for drilling soft and medium formations. Various configurations for wedge-shaped inserts are shown in U.S. Pat. No. 3,442,342 issued to Hughes Tool Company. Inserts of this type have a pair of symmetrical flanks that converge to a rounded crest. The inserts are interferringly secured in holes drilled normal to the cutter surface. Consequently as the cutter rotates, the crest initially contacts the formation at a time when the longitudinal axis of the insert is non-perpendicular with respect to the hole bottom. Bending stresses are thus generated in the inserts, tending to cause breakage.

SUMMARY OF THE INVENTION

In accordance with this invention, an insert is provided having asymmetrical flanks. In the preferred embodiment, the leading face or flank is concave and the trailing flank is convex. The scoop-shaped leading flank aids in lifting cuttings, yet resists breakage because of the additional support provided by the convex trailing flank and improved stress distribution.

DESCRIPTION OF THE PREFERRED EMBODIMENT

Figure 1:
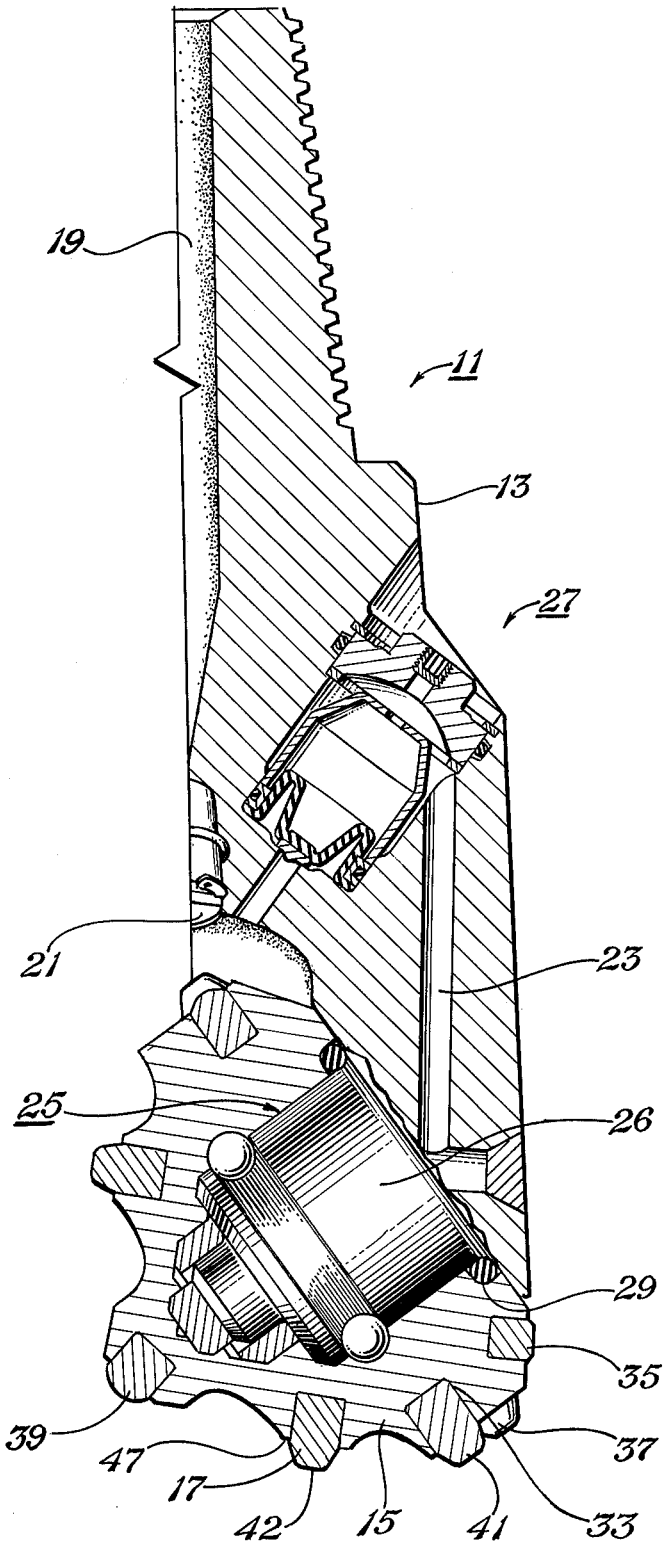
FIG. 1 is a fragmentary view in longitudinal section of one of the three sections and assembled cutter of a three cone rock bit having inserts constructed in accordance with the principles of this invention.

The numeral 11 in FIG. 1 of the drawings designates a lubricated, rotatable cutter-type earth boring drill bit having a body 13 formed in three sections (and subsequently welded) that each support a rotatable cutter 15 having earth disintegrating teeth 17. The drill bit has an axial fluid passage 19 extending through the body and usually three nozzles 21 at the body's lower end for the discharge of drilling fluid against the borehole bottom. Passages 23 supply lubricant to the bearing means 25 between the cutter 15 and supporting shaft 26. A pressure compensator system 27 helps provide lubricant through passages 23 to the bearing means 25, and limits, preferably equalizing, the pressure differential across seal 29.

Figure 5:
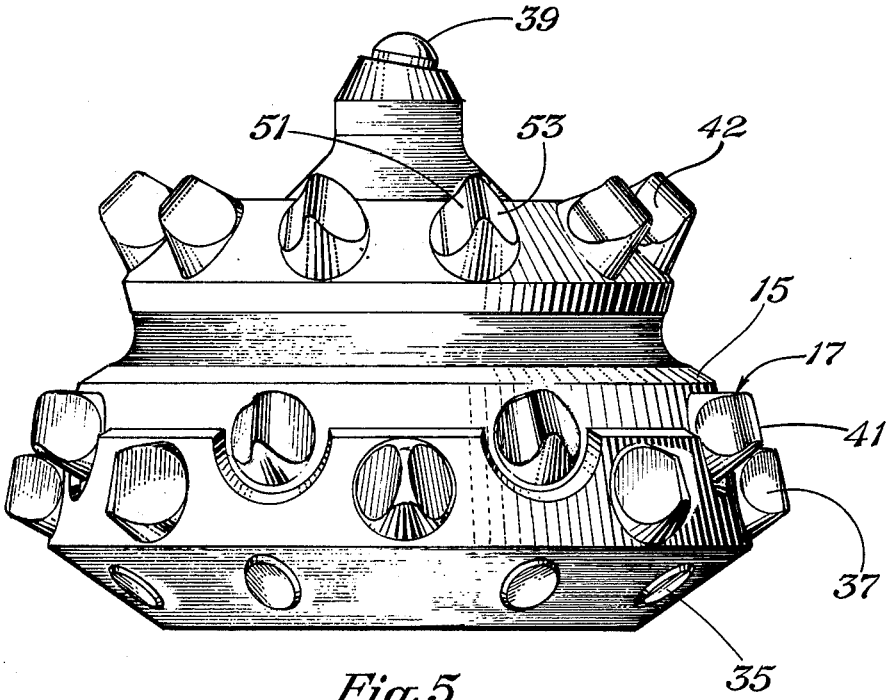
FIG. 5 is a side elevational view of a cutter for use with the drill bit shown in FIG. 1 and containing inserts as shown in FIGS. 2 through 4.

The inserts 17 are formed of sintered tungsten carbide in the desired shape in a pressing mold. Each insert 17 is pressed into drilled and reamed retaining holes 33 with an interference fit. The drill bit of FIG. 1 contains three cutters 15, the one shown in FIG. 1 and FIG. 5 normally being designated as the number one cutter. All three cutters normally contain a row of gage inserts 35 and a heel row of inserts 37 on the outer end of the cutter. In the illustrated bit, the number one and number two cutters (not shown) have one or more nose inserts 39 on the inner end. A pair of inner rows 41, 42 are located between the inner end and the heel row inserts 37 on each cutter. The nose row inserts 39 shown in FIG. 5 are of the prior art ovoid configuration. The heel row inserts 37 shown in FIG. 5 are also of a prior art configuration, shown more clearly in FIG. 7 through 10 of U.S. Pat. No. 3,442,342. That type of insert has short flanks that are symmetrical to each other but canted away from each other so that the crest is not of uniform width.

Figure 3:
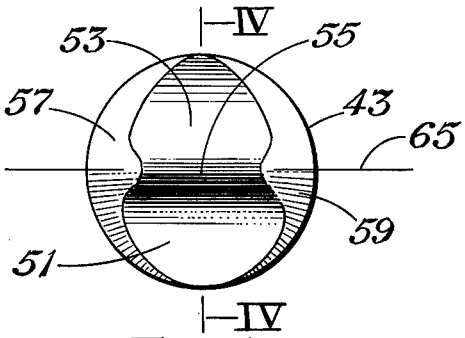
FIG. 3 is a top view of the insert of FIG. 2.
Figure 2:
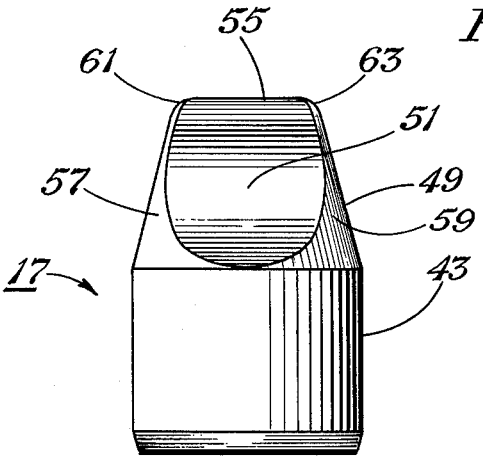
FIG. 2 is a front elevational view of an insert of the invention.
Figure 4:
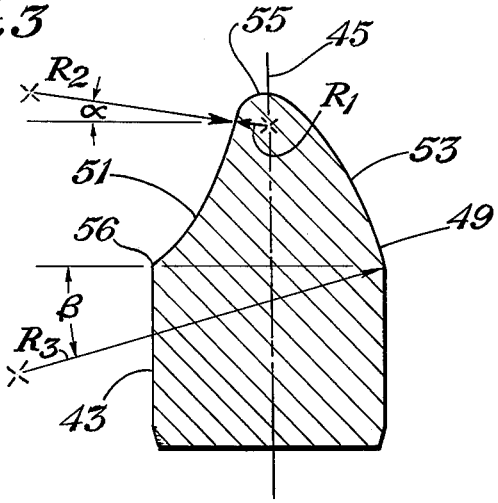
FIG. 4 is a sectional view of the insert of FIG. 3, taken along the lines IV—IV.

The inner row inserts 41, 42 are generally chisel-shaped and have a special configuration as shown in FIGS. 2 through 4. The inserts of inner rows 41, 42 have a cylindrical base 43 which is inserted in retaining hole 33 with its longitudinal axis 45 being normal to the surface 47 of cutter 15. A cutting tip 49 is formed integrally with a cylindrical base 43 and protrudes outwardly from cutter surface 47. The cutting tip has two faces or flanks comprising a leading flank 51 and trailing flank 53. Flanks 51, 53 commence at the joinder of the cutting tip 49 with the top 56 of base 43 and converge in a crest 55. Adjacent and connecting each flank, conical surfaces 57, 59 extend from the junction of the cutting tip 49 with the top 56 of base 43 to the crest 55. As shown in FIG. 2, these conical surfaces incline inward or toward each other approximately 15° from the vertical. "Vertical" is defined herein to be parallel with the longitudinal axis 45. The corners 61, 63 of the crest 55 at the junction with the conical surfaces 57, 59 are also rounded.

As is apparent from FIG. 4, the flanks 51, 53 are asymmetrical with respect to each other. A median plane 65 passing through longitudinal axis 45 divides the crest 55 in half along its length, defining two halves or portions that are asymmetrical. One portion contains a concave or depressed flank and the other a convex or rounded outward flank. "Concave" and "convex" are used generically herein to include surfaces not lying in a single plane, such as a flank with a combination of flat and curved surfaces, and not in the most limited sense to mean only portions of a sphere. Flank 51 is concave in a section that contains the longitudinal axis 45 and is normal to crest 55, which is the view shown in FIG. 4. Trailing flank 53 is convex as seen in that same sectional view.

In the preferred embodiment, the longitudinal axis 45 of the preferred insert is within the median plane 65 of crest 55. The cross section of crest 55 is also curvilinear, preferably arcuate, with the center point of its radius $R_1$ located on the longitudinal axis 45 as seen in FIG. 4. The center point of radius $R_2$ forming the concave flank 51 is preferably located on a line commencing from the center point of $R_1$ at a positive angle $\alpha$ of preferably 10° with respect to a line normal to the axis 45. This radius has a length to extend to the top 56 of cylindrical base 43 and tangent to the radius $R_1$. For the convex flank 53, the center point of radius $R_3$ is located along a line commencing at the top 56 of the cylindrical base 43 at a negative angle $\beta$ of preferably 10° to 15° with respect to a line normal to the axis 45 and is tangent to $R_1$.

For an insert with a base 43 of 0.6278 inch diameter the total height of the insert is preferably 0.938 inch and the height of cylindrical base 43 is 0.488 inch. The radius of the crest 55 is preferably 0.094 inch. The radius $R_2$ of the concave flank 51 for a 10° reference angle $\alpha$ is 0.617 inch, and the radius $R_3$ of the convex flank 53 is 0.922 inch for a 15° reference angle $\beta$.

It should be apparent that an invention having significant advantages has been provided. The asymmetrical insert has a tilting effect that is believed to improve stress distribution. The scoop-shaped cutting tip meets the formation more squarely during drilling and tends to mechanically lift the cuttings. The rounded trailing flank adds strength to prevent breakage.

While the invention has been shown in only one of its forms, it should be apparent to those skilled in the art that it is not so limited but is susceptible to various changes and modifications without departing from the spirit thereof.

I claim:

1. In combination with a rolling cutter earth boring drill bit of the insert type, a shaped insert having a base integrally joined to a cutting tip, the cutting tip having a leading flank and a trailing flank converging to an elongated single crest, the leading flank being concave as seen in a longitudinal section taken normal to the elongated crest.

2. In combination with a rolling cutter earth boring drill bit of the insert type, a shaped insert having a base integrally joined to a cutting tip, the cutting tip having a leading flank and a trailing flank converging to a single elongated crest which intersects the longitudinal axis of the base, the leading flank being concave as seen in a longitudinal section taken normal to the crest, the trailing flank being asymmetrical with respect to the leading flank.

3. In combination with a rolling cutter earth boring drill bit of the insert type, a shaped insert having a base integrally joined to a cutting tip, the cutting tip having a leading flank and a trailing flank converging to a single elongated crest perpendicular to the longitudinal axis of the base, the leading flank being curved inward as seen in a longitudinal section taken normal to the crest and the trailing flank being curved outward as seen in said section.

4. In combination with a rolling cutter earth boring drill bit of the insert type, a shaped insert having a base integrally joined to a cutting tip, the cutting tip having a leading flank and a trailing flank converging to a single elongated crest with rounded edges and through which the longitudinal axis of the base passes, the leading flank being curved inward and the trailing flank being curved outward as seen in a section taken normal to the crest and containing the longitudinal axis.

5. In combination with an insert bit having rolling cutters with wear resistant inserts having generally chisel-shaped cutting tips with leading and trailing flanks, an improved insert having a leading flank that is concave in a longitudinal plane normal to it and a trailing flank that is convex in a longitudinal plane normal to it.

6. In combination with a rolling cutter earth boring drill bit of the insert type, a shaped insert having a base integrally joined to a cutting tip, the cutting tip having a leading flank and a trailing flank converging to a crest of uniform width extending between the flanks, a conical surface joining the base and extending to the flanks; the leading flank being concave, the trailing flank convex, and the crest rounded in a sectional plane containing the longitudinal axis of the base and normal to the crest.

7. In combination with a rolling cutter for an insert type rock bit, the cutter having an outer surface with cutting structure thereon adapted to roll over the bottom of a hole in a rock formation to disintegrate the bottom, the cutting structure including an improved inner row insert having a cylindrical base integrally joined to a cutting tip with a leading flank and a trailing flank extending from the base to a single rounded and elongated crest that is centered on the longitudinal axis of the base and perpendicular to it, a pair of conical surfaces adjacent the flanks and joining them, the base and the crest, the trailing flank being asymmetrical with respect to the leading flank and arcuate and convex as seen in a longitudinal section taken normal to the crest.

* * * * *